United States Patent [19]

Nakajima et al.

[11] 3,955,983

[45] May 11, 1976

[54] PROCESS FOR FORMING A COLOR IMAGE ON AN EXPOSED PHOTOSENSITIVE MATERIAL

[75] Inventors: Yosuke Nakajima; Yoshihiko Yamada; Haruhiko Iwano; Katsuhiko Ohtani, all of Minami-ashigara, Japan

[73] Assignee: Fuji Photo Film Co., Ltd., Minami-ashigara, Japan

[22] Filed: Dec. 12, 1974

[21] Appl. No.: 532,104

Related U.S. Application Data

[63] Continuation-in-part of Ser. No. 240,484, April 3, 1972, abandoned.

[30] Foreign Application Priority Data

Apr. 2, 1971 Japan ..... 46-20190

[52] U.S. Cl. ..... 96/55; 96/66 R; 96/66 HD; 96/66.3; 96/66.5; 96/82; 250/475

[51] Int. Cl.[2] ..... G03C 7/00

[58] Field of Search ..... 96/55, 66 R, 66 HD, 96/66.3, 66.5, 82; 250/475, 477

[56] References Cited

UNITED STATES PATENTS

| | | | |
|---|---|---|---|
| 2,950,970 | 8/1960 | Schwan et al. | 96/56.2 |
| 3,362,820 | 1/1968 | Hellmig | 96/9 |
| 3,518,085 | 6/1970 | Milton et al. | 96/66.3 |
| 3,545,971 | 12/1970 | Barnes et al. | 96/61 |
| 3,658,525 | 4/1972 | Bent et al. | 96/66 R |
| 3,679,423 | 7/1972 | Pollet et al. | 96/66.5 |
| 3,734,735 | 5/1973 | Bories | 96/82 |

*Primary Examiner*—J. Travis Brown
*Attorney, Agent, or Firm*—Sughrue, Rothwell, Mion, Zinn & Macpeak

[57] ABSTRACT

A high contrast, high density color image is formed on a silver halide photosensitive monochromatic, e.g., irradiated by X-rays, by subjecting the photosensitive material to coupling or color development with a developer solution containing a p-phenylene diamine developing agent and 1-phenyl-3-pyrazolidone and then, without desilverization, to fixing. The coupler may be contained in the silver halide photo-emulsion or in a developing solution.

10 Claims, 9 Drawing Figures

PROCESS FOR FORMING A COLOR IMAGE ON AN EXPOSED PHOTOSENSITIVE MATERIAL

CROSS-REFERENCE TO RELATED APPLICATION

This application claims the benefit under 35 USC 120 of copending application Ser. No. 240,484, filed Apr. 3, 1972, now abandoned, of which this application is a continuation-in-part.

BACKGROUND OF THE INVENTION

1. Field of the Invention

This invention relates to a process for forming a color image, for example, by using X-rays and, in particular, to a process for quickly obtaining a color image of good quality by subjecting an exposed photosensitive material to a development treatment without a desilverization or a bleaching step.

2. Description of the Prior Art

There has hitherto been known a process for forming a color image using an X-ray sensitive material by coupling or color development of a X-ray sensitive material containing a coupler. This process, however, has the drawback that it requires complicated procedures and equipment for performing the development and subsequent desilverization and fixing and also a long processing time. In addition, such prior processes have another disadvantage in that the color image obtained is only slightly discernable by observation using transmitted light because of the low contrast and density of the image.

It is an object of the present invention to provide a process for forming quickly a color image of a high contrast and a high density on a monochromatic material.

It is another object of the present invention to provide a process for forming quickly a color image of a high contrast and a high density on a monochromatic X-ray sensitive material.

It is still another object of the present invention to provide a process for forming quickly a color image of a high contrast and a high density on a color X-ray sensitive material.

SUMMARY OF THE INVENTION

The process of the present invention for forming a colored monochromatic image comprises subjecting a silver halide monochromatic material which has been exposed through an original to color development with a developer solution containing a p-phenylene diamine developing agent and 1-phenyl-3-pyrazolidone and then, without desilverization, to fixing.

BRIEF DESCRIPTION OF THE ACCOMPANYING DRAWINGS

FIG. 1 graphically illustrates a characteristic curve of an X-ray image formed in accordance with the prior process, FIGS. 2 to 7 graphically illustrate the characteristic curves of X-ray color images formed in accordance with the process of the present invention, FIG. 8 graphically illustrates the effect of a complementary color filter on the X-ray color image formed in accordance with the process of the present invention, and FIG. 9 graphically illustrates the effect obtained with the omission of the bleaching step.

DETAILED DESCRIPTION OF THE INVENTION

Figure 1:
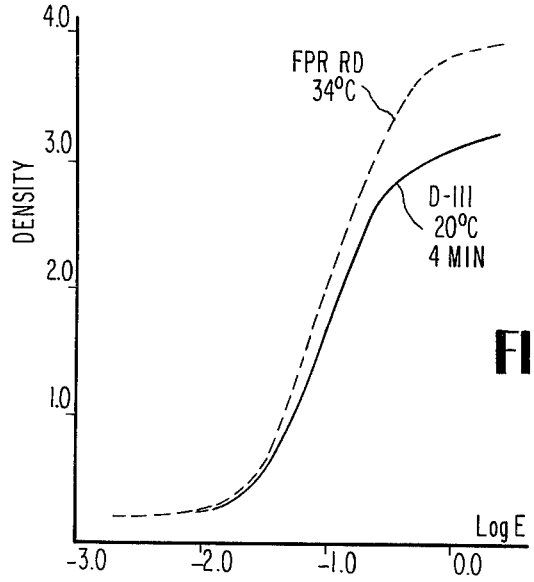

The process of the present invention involves the development of an exposed monochromatic photosensitive material, for example, an X-ray sensitive material, and then fixing without any desilverizing or bleaching step. Therefore, the material may or may not contain a coupler. Where a coupler is not contained in the material, the material is developed in a color developing solution containing a coupler.

In the practice of the present invention, any of the conventional color couplers and conventional color developing solutions may suitably be used and in the fixing step, any of the conventional fixing solutions can be suitably used, for example, those disclosed in U.S. Pat. Nos. 2,592,243; 2,950,970 and 2,252,718. It is prefered to use a fixing solution having a film hardening effect in an automatic developing machine.

The process of the present invention for treatment of exposed photosensitive materials corresponds to conventional processing, for example, color development in a developing solution containing a paraphenylene diamine developing agent, the oxidation product of which couples with a color coupler contained either in the developing solution or the silver halide emulsion, except that a desilverizing or bleaching step is omitted from the conventional development processing and the developing solution contains 1-phenyl-3-pyrazolidone. The processing can be carried out in various manners, e.g., using an automatic developing machine without a desilverization or bleaching unit or in a vat development.

The process of the present invention as disclosed hereinafter in detail will be with reference to conventional monochromatic materials.

A monochromatic material, for example, as described in U.S. Pat. No. 3,545,971, prepared by applying a gelatin-silver iodobromide emulsion to both sides of a support is exposed to X-rays through an object and subject to monochromatic development, color development in a developing solution containing a cyan coupler and fixing. If desired, the material exposed to X-rays may be washed or rinsed with water between the above successive steps.

Sensitized development is attainable by addition of both 1-phenyl-3-pyrazolidone and a poly(oxyethylene)glycol derivative to the color developing solution.

Table 1

| Process | Color Development | Other Processing Steps | Total Processing Time |
|---|---|---|---|
| Prior Process | Vat development | Washing, bleaching, washing, fixing, washing and drying | About 50 to 70 minutes |
| Present Process | Do. | Washing, fixing, washing and drying | About 40 to 60 minutes |
| Prior Process | Automatic development | Washing, fixing, washing, drying, bleaching, washing, fixing, washing | About 30 minutes |

Table 1-continued

| Process | Color Development | Other Processing Steps | Total Processing Time |
|---|---|---|---|
| | | and drying | |
| Present Process | Do. | Washing, fixing, washing and drying | About 3.5 to 4 minutes |

The image obtained in the process of the present invention is formed of a silver image and a color image and is superior in photographic tone, especially in terms of contrast at a high density in comparison with an ordinary image formed by a color image alone.

The poly(oxyethylene)glycol derivative suitably used in the practice of the process of the present invention includes poly(oxyethylene)glycol itself and nonionic-, anionic- and cationic- derivatives thereof which are soluble in water or which are swelled by water. The poly(oxyethylene) chain of such derivatives has molecular weights ranging from about 400 to 4,000, preferably about 1,000 to 2,200. The term poly(oxyethylene)glycol derivative as used herein includes a variety of compounds, some of which are as follows:

(I) Nonionic Compounds

1. Poly(oxyethylene)glycols of molecular weights of about 400 or more, such as Carbowax 1540, Carbowax 4000 and Carbowax 1200 supplied by the Union Carbide and Chemical Corp., USA, Carbowax 1540 being a solid having an average degree of polymerization of about 35, an average molecular weight of about 1,300 to 1,600, a specific gravity of 1.15 and a solidification temperature of about 43° to 46°C, 2. Poly(oxyethylene)glycol methyl phenyl ethers of molecular weights of about 500 or more, for example, a material having a degree of a polymerization of the poly(oxyethylene) chain of about 25 or 50, supplied by the Nippon Emulsion Kabushiki Kaisha, Japan, 3. Poly(oxyethylene) alkyl ethers, such as a poly(oxyethylene) lauryl ether having an HLB (hydrophilic/-lipophilic balance) of 9.5 supplied by the Atlas Co., USA, and a poly(oxyethylene) lauryl ether having a degree of polymerization of the poly(oxyethylene) chain of about 20, a poly(oxyethylene) oleyl ether having a degree of polymerization of about 50 and a poly(oxyethylene) octyl ether having a degree of polymerization of about 50 supplied by Nippon Emulsion Kabushiki Kaisha, Japan, 4. Poly(oxyethylene) nonylphenyl ethers, such as those having a degree of polymerization of about 30, 40 and 50 supplied by Nippon Emulsion Kabushiki Kaisha, Japan, 5. Poly(oxyethylene)sorbitan esters, such as poly(oxyethylene) sorbitan monooleate having an HLB of 15.0 and poly(oxyethylene) sorbitan monostearate having a HLB of 14.9 supplied by the Atlas Co., USA, and poly(oxyethylene)sorbitan monolaurate having degrees of polymerization of 30 and 50 supplied by Nippon Emulsion Kabushiki Kaisha, Japan, 6. Poly(oxyethylene)-(oxypropylene) block copolymers, such as Pluronics L-61 having an average molecular weight of about 1940 and containing about 10% by weight oxyethylene units, L-62 having an average molecular weight of about 2190 and containing about 20% by weight oxyethylene units, L-64 having an average molecular weight of about 2916 and containing about 40% by weight oxyethylene units, L-68 having an average molecular weight of about 8760 and containing about 80% by weight oxyethylene units and L-75 having an average molecular weight of about 4100 and containing about 50% by weight oxyethylene units supplied by the Wyandotte Co., USA and 7. Poly(oxyethylene) alkyl esters, such as poly(oxyethylene) monostearate having an HLB of 17.9 supplied by the Atlas Co., USA poly(oxyethylene) dilaurate having a degree of polymerization of about 23 supplied by the Nippon Oil and Fat Co., Japan, and poly(oxyethylene) monolaurate having a degree of polymerization of about 50 supplied by the Nippon Emulsion Kabushiki Kaisha, Japan;

(II) Cationic Compounds

8. Poly(oxyethylene)-bis(pyridinium methanesulfonate),

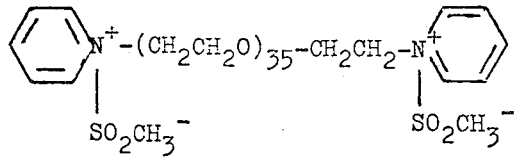

synthesized in accordance with the process disclosed in U.S. Pat. No. 2,950,970; and (III) Anionic Compounds 9. Polyethoxyethyl-bix-sulfuric acid $$HSO_3—O(CH_2CH_2O)_{35}—SO_3H$$

snythesized by the process as disclosed in British patent specification No. 859,632.

A color developing solution containing hydroquinone and 1-phenyl-3-pyrazolidone as a developing promotor, as disclosed in British patent specification No. 811,185, and a color developing solution containing poly(oxyethylene) glycols as an agent for increasing density of the color image and eliminating fog, as disclosed in U.S. Pat. No. 2,950,970, are known but these solutions do not exhibit any marked superiority to conventional X-ray developers when used as a developer for X-ray sensitive materials.

In the practice of the process of the present invention, there may be added, in addition to the 1-phenyl-3-pyrazolidone and a poly(oxyethylene) glycol derivative, an antifogging agent such as 6-nitrobenzimidazole nitrate, indazole, benzotriazole, potassium bromide, potassium iodide, and the like, with 6-nitrobenzimidazole nitrate being preferred, to a developing solution to prevent an increase in fog caused by the sensitization by the 1-phenyl-3-pyrazolidone and the poly(oxyethylene) glycol derivative.

We have found that the addition of 1-phenyl-3-pyrazolidone effects excellent results in the ratio of dye density to silver density and the developing acceleration. These effects are even more superior when poly- (oxyethylene)glycol is further incorporated into the developing solution. The most preferred additive to the developing solution also contains 6-nitrobenzimidazole nitrate.

Other additives such as alkali agents such as sodium hydroxide, sodium carbonate, sodium phosphate and the like, preservatives such has hydroxylamine and sodium sulfite, coupler solvents such as hexylene glycol ethylene glycol, acetone, ethanol and the like, sequestering or water softening agents such as sodium hexametaphosphate and the like and additives which strengthen the pH such as sodium sulfate and sodium nitrate.

In case of an external color developing solution, it is effective to add from about 0.05 to 0.5 g of the 1-phenyl-3-pyrazolidone from about 0.5 to 5 g of the poly-(oxyethylene) glycol and from about 5 to 150, preferably about 20 to 50 mg of 6-nitrobenzimidazole nitrate to 1 liter of the developing solution.

The process of the present invention may be carried out using either vat developing, manual developing or automatic developing.

As summarized in Table 1 above, in case of vat development, the processing time is shortened by approximately 10 minutes because of the ability to omit the drying and the bleaching steps, and, in case of automatic development, the processing time is markedly shortened to only 3 to 4 minutes because of the omission of the drying, bleaching, washing, fixing and washing steps subsequent to the developing step which must be carried out in an apparatus other than an automatic developing machine and takes a total time of about25 minutes, the automatic developing machines now commercially available not being provided with bleaching means.

The process of the present invention will be illustrated in greater detail by reference to the following examples which are for the purposes of illustration and are not to be construed as limiting the scope of the invention.

EXAMPLE 1

An X-ray film consisting of a poly(ethylene terephthalate) base having a coated layer of a silver iodobromide X-ray emulsion, Fuji medical X-ray film KX, produced by the Fuji Photo Film Co., was exposed using a Toshiba X-ray generator KXO-15 (500 mA 150 KVP, focus 1.0 × 1.0 to 1.5 ×1.5) through a lithform (a lattice grid for screening scattered rays) with a lattice ratio of 8:1 using an intensifying screen, Kyokko FS produced by the Dai-Nippon Toryo Kabushiki Kaisha, in the same manner as in conventional monochromatic X-ray photographing.

The treating solutions used had the following compositions:

-continued

| | |
|---|---|
| Potassium Bromide | 1.0 g |
| Potassium Iodide (0.1 % aqs. soln.) | 5 ml |
| 3-Benzoyl-4-(p-toluenesulfonamide) acetanilide | 1.2 g |
| Sodium Hydroxide | 2.5 g |
| Water in an amount to provide a solution of | 1.0 liter |
| **Yellow Developing Solution** | |
| Anhydrous Sodium Sulfite | 5.0 g |
| 4-Amino-N, N-diethylaniline Sulfate | 2.5 g |
| Potassium Bromide | 1.0 g |
| Potassium Iodide (0.1% aqs. soln.) | 5 ml |
| 1, 5-Dihydroxy-2,6-dibromonaphthalene | 1.2 g |
| Sodium Hydroxide | 2.5 g |
| Water in an amount to provide a solution of | 1.0 liter |
| **Magenta Color Developing Solution** | |
| Anhydrous Sodium Sulfite | 5.0 g |
| 4-Amino-N, N-diethylaniline Sulfate | 2.5 g |
| Potassium Bromide | 1.0 g |
| Potassium Iodide (0.1 % aqs. soln.) | 5 ml |
| 1-Phenyl-3-(m-nitrobenzoylamino)-5-pyrazolone | 1.4 g |
| Sodium Hydroxide | 2.5 g |
| Water in an amount to provide a solution of | 1.0 liter |
| **for Color Developing Solution** | |
| (per liter of solution) | |
| 1-Phenyl-3-pyrazolidone | 0.2 g |
| Poly (oxyethylene) Glycol (mol weight about 1500) | 1.0 g |
| 6-Nitrobenzimidazole Nitrate | 0.03 g |
| **Solution** | |
| (Acidic film hardening fixing solution) | |
| Crystalline Sodium Thiosulfate | 240.0 g |
| Anhydrous Sodium Sulfite | 15.0 g |
| Glacial Acetic Acid | 13.3 g |
| Boric Acid | 7.5 g |
| Powdered Potassium Alum | 15.0 g |
| Water in an amount to provide a solution of | 1 liter. |

The above cyan, yellow and magenta developing solutions develop cyan, yellow and magenta images, respectively, when used alone. It is possible to develop an image of a desired color by using them in admixture in appropriate proportions. In this example, a mixture of the cyan developing solution and the magenta developing solution in a ratio of 1:1 was used to obtain a blue image.

The treatment of an exposed film was carried out using a Fuji X-ray Processor RN, a medical X-ray film automatic developing machine produced by the Fuji Photo Film Co., under the following conditions: development at 33°, 35° or 37°C, for 1 to 15 minutes; fixing at 35°C, for 0.5 to 1 minute; and drying at 50° to 53°C, for 0.75 to 1 minute.

Figure 3:
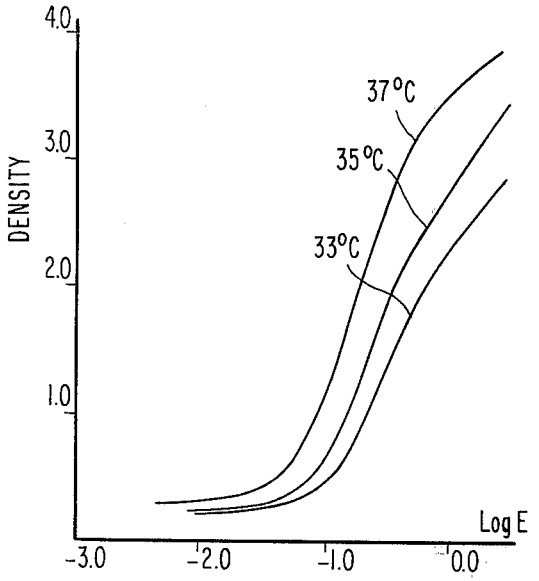

The characteristic curve determined using a red filter on the blue image thus obtained is shown in FIG. 3. This image was an easily discernible X-ray color image having a high color density and a high contrast.

Figure 8:
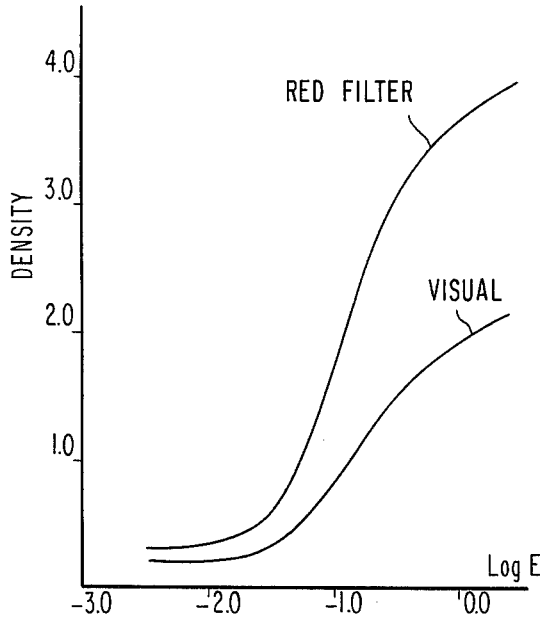

The characteristic curve obtained by using a red filter (Red Filter Auto Positive Filter OR-1manufactured by the Fuji Photo Film Co., Ltd.) and that obtained using no filter (Visual) are summarized in FIG. 8 for comparison.

EXAMPLE 2

The same exposed X-ray films as were used in Example 1 were processed under the same conditions as described in Example 1 except for those otherwise indicated in the following Table 2.

| | |
|---|---|
| **Cyan Color Developing Solution** | |
| Anhydrous Sodium Sulfite | 5.0 g |
| 4-Amino-N, N-diethylaniline Sulfate | 2.5 g |

Table 2

| No. | Example 1 Additive For Color Developing Solution | Developing Manner | Developing Temperature (°C) | Developing Time(min) | Fig. No. |
|---|---|---|---|---|---|
| | Yes | Fuji X-ray Processor RN | 33, 35, 37 | 1 – 1.5 | 2 |
| 2 | No | Fuji X-ray Processor RN | 33, 35, 37 | 1 – 1.5 | 3 |

Table 2-continued

| No. | Example 1 Additive For Color Developing Solution | Developing Manner | Developing Temperature (°C) | Developing Time(min) | Fig. No. |
|---|---|---|---|---|---|
| 3 | Yes | Vat Developing | 20 | 3, 4, 6, 8 | 4 |
| 4 | No | Do. | 20 | 3, 4, 6, 8 | 5 |
| 5 | Yes | Do. | 35 | 0.5,1,1.5,2,3,4 | 6 |
| 6 | No | Do. | 35 | 0.5,1,1.5,2,3,4 | 7 |

Although X-ray color images of qualities similar to those as in Example 1 were obtained, the images of No. 1, 3 and 5 were superior in quality to the images of No. 2, 4 and 6 because of the addition to the developing solution of the additive. Due to the sensitizing action of the additive, the developing power of the No. 1, 3 and 5 solutions was about 2 times that of the No. 2, 4 and 6 solutions.

EXAMPLE 3 (Comparative)

The same exposed X-ray film as was used in Example 1 was processed under the conditions as indicated in the following Table 3 to obtain monochromatic images.

Table 3

| Developing Manner | Developing Agent | Temperature | Time |
|---|---|---|---|
| Fuji X-ray Processor R[1] | D- 111[2] | 34°C | 1 – 1.5 minutes |
| Vat Development | D- 111 | 20°C | 4 minutes |

Note:
[1]X-ray film automatic developing machine produced by the Fuji Photo Film Co., Ltd.
[2]Powdery prepared developing agent for X-ray films produced by the Fuji Photo Film Co., Ltd. and containing 4.0 g of p-methyl aminophenol, 60 g of sodium sulfite (anhydrous), 10 g of hydroquinone, 53 g of sodium carbonate (anhydrous) and 2.5 g of potassium bromide in water to make 1 liter.

The characteristic curves determined on the monochromatic images thus obtained were as shown in FIG. 1.

Figure 2:
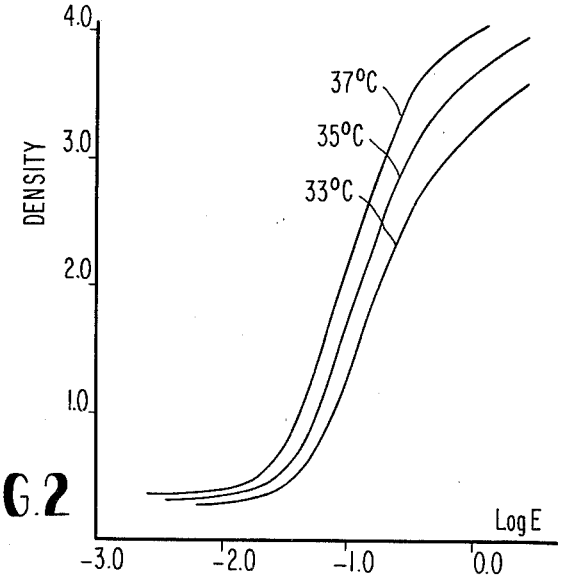
Figure 4:
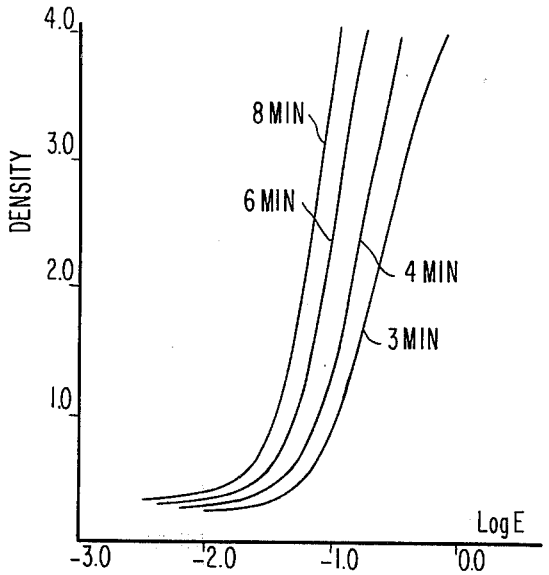
Figure 5:
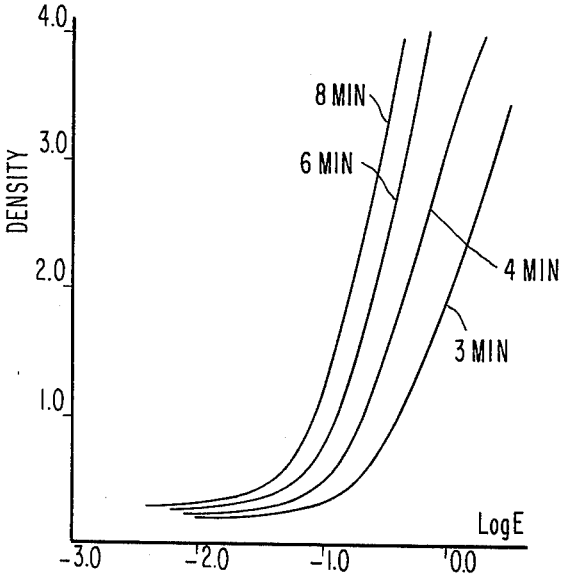
Figure 6:
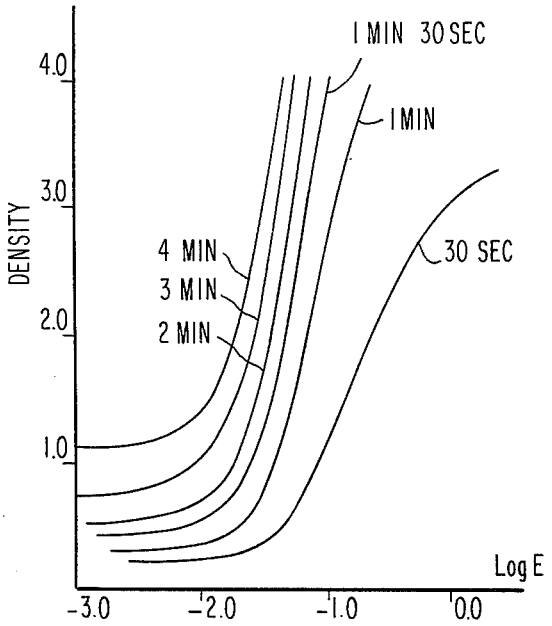
Figure 7:
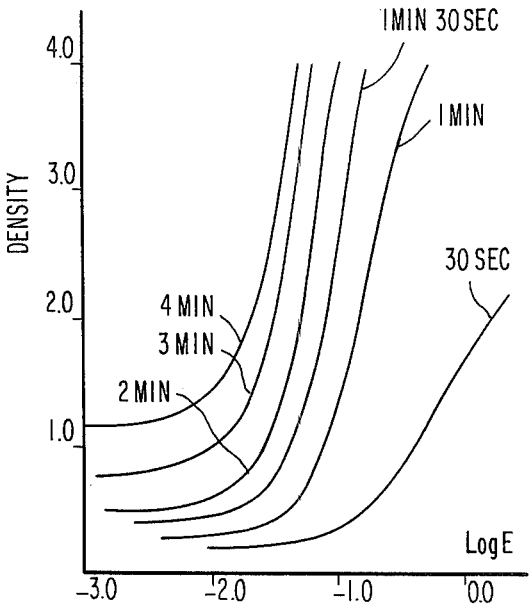

It will be noticed on comparison of FIG. 1 with FIGS. 2, 4 and 6 that in the process of the present invention there is obtained a photograhic sensitivity equivalent to that obtained in a standard process for processing monochromatic X-ray films. In the following Table 4 the processing conditions for obtaining images of a quality corresponding to that of monochromatic images obtained in the conventional standard process are summarized.

Table 4

| | Developing Manner | Developing Temperature (°C) | Developing Time (min.) |
|---|---|---|---|
| From FIG. 2 | Fuji X-ray Processor RN | 35 – 37 | 1 – 1.5 |
| From FIG. 3 | Vat Developing | 20 | 5 – 6 |

Table 4-continued

| | Developing Manner | Developing Temperature (°C) | Developing Time (min.) |
|---|---|---|---|
| From FIG. 4 | Do. | 35 | 1 |

EXAMPLE 4 (Comparative)

Figure 9:
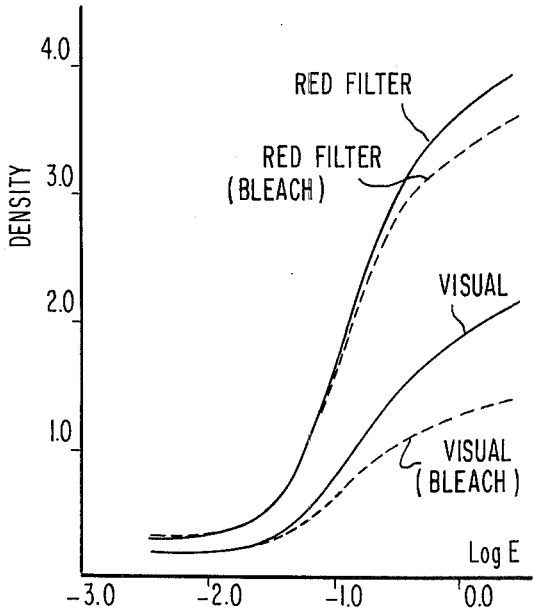

The same procedure as described in Example 1 was repeated except that the developed film was subjected to a bleaching in the conventional manner prior to fixing. The results obtained are shown in FIG. 9 in comparison with the results obtained in Example 1.

In this example, a bleaching solution of the following composition was used.

| Bleaching Solution | |
|---|---|
| Potassium Ferricyanide | 100 g |
| Potassium Bromide | 10 g |
| Borax | 20 g |
| Boric Acid | 1.0 g |
| Water in an amount to provide a solution of | 1 liter |

Water in an amount to provide a solution of 1 liter

It will be noticed from the curves shown in FIG. 9 that in the process of the present invention an increase in sensitivity is obtainable regardless of the use of a filter or not. This seems to be attributable to the synergistic effect of a density of an unbleached silver image and of a color image.

EXAMPLE 5

The procedure as described in Example 1 of the present application was repeated but using only the cyan color developing solution therein set forth. The yellow developing solution and the magenta color developing solution described in Example 1 were excluded from this experiment.

The additive, i.e., 1-phenyl-3-pyrazolidone, was used in the same amount as that used in Example 1.

1'. The exposed film was developed under the same conditions as used in Example 1 and a ratio of dye density ($D_{dye}$) using a red filter and Ag density ($D_{Ag}$) using a blue filter were determined at 0.05 CMS. The results obtained and the developer solutions used are shown in the Table below in which the densities were determined at $D_{max}$.

| | Developing Time 30 sec. | | | 60 sec. | | | 90 sec. | | |
|---|---|---|---|---|---|---|---|---|---|
| | $D_{dye}$ | $D_{Ag}$ | $D_{dye}/D_{Ag}$ | $D_{dye}$ | $D_{Ag}$ | $D_{dye}/D_{Ag}$ | $D_{dye}$ | $D_{Ag}$ | $D_{dye}/D_{Ag}$ |
| Cyan Color Developing Solution | 0.37 | 0.15 | 2.5 | 0.93 | 0.37 | 2.6 | 1.45 | 0.52 | 2.8 |
| Cyan Color Developing Solution plus 1-Phenyl-3-Pyrazolidone | 2.27 | 0.52 | 4.4 | 3.27 | 0.79 | 4.1 | 3.71 | 1.08 | 3.4 |

The results show that the addition of 1-phenyl-3-pyrazolidone remarkably increases the ratio of $D_{dye}$-$D_{Ag}$.

EXAMPLE 6

The developing acceleration effect was determined under the same conditions as above (at 0.05 CMS and at $D_{max}$) using the four different types of the developing solutions as described below

| | Example No. | Developing Time 30 sec. | 60 sec. | 90 sec. |
|---|---|---|---|---|
| 1. | Cyan Color Developing Solution(1) | 0.36 | 0.64 | 0.88 |
| 2 | (1)+1-Phenyl-3-Pyrazolidone | 1.10 | 1.44 | 1.66 |
| 3. | (1)+1-Phenyl-3-Pyrazolidone +PEO | 1.15 | 1.56 | 1.70 |
| 4. | PEO | 0.48 | 0.95 | 1.20 |

| | ΔD (60 sec.) |
|---|---|
| Effect of PEO (Sample No.4-Sample No.1) | +0.31 |
| Effect of 1-Phenyl-3-Pyrazolidone (Sample No. 2 - No.-) | +0.80 |
| Effect of 1-Phenyl-3-Pyrazolidone and PEO (Sample No.3 - No. 1) | +0.92 |

The additives, i.e., 1-phenyl-3-pyrazolidone and poly-(oxyethylene)glycol (PEO) were used in the same amount as that used in Example 1.

The above results indicate that each of the additives is effective for accelerating the development. (Samples Nos. 2–4)

EXAMPLE 7

Fog Preventing Effect by 6-Nitrobenzimidazole nitrate (at 0.05 CMS)

| | Developing Time 30 sec. | | 60 sec. | | 90 sec. | |
|---|---|---|---|---|---|---|
| | Fog | D | Fog | D | Fog | D |
| Cyan Color Developer + PEO and 1-Phenyl-3-Pyrazolidone | 0.13 | 1.00 | 0.70 | 1.50 | 1.10 | 1.54 |
| Cyan Color Developer + PEO, 1-Phenyl-3-Pyrazolidone and 6-Nitrobenzimidazole nitrate | 0.03 | 0.95 | 0.17 | 1.45 | 0.36 | 1.69 |

The additives, i.e., 1-phenyl-3-pyrazolidone, PEO, and 6-nitrobenzimidazole nitrate were used in the same amount as that used in Example 1.

The above results indicate that the developer solution containing 6-nitrobenzimidazole nitrate is superior to that without the fog preventing agent and that the combination of 1-phenyl-3-pyrazolidone, PEO, and 6-nitrobenzimidazole nitrate is effective for preventing fog without causing a decrease in the maximum density of the color.

What is claimed is:

1. In a process for forming a color image of an image on a photographic X-ray element having coated on opposite surfaces of a support monochromatically photosensitive silver halide emulsion layers including the steps of subjecting the X-ray image-wise exposed element to color development in the presence of a color coupler with a developer solution containing a p-phenylene diamine developing agent whereby said color coupler couples with the oxidation product of said developing agent to form a color image in said element and fixing said color image in said element, the improvement comprising omitting desilverization from said color development and said developer solution additionally containing 1-phenyl-3-pyrazolidone.

2. The process as claimed in claim 1, wherein said color coupler is present in said silver halide emulsion.

3. The process as claimed in claim 1, wherein said color coupler is present in said developer solution.

4. The process as claimed in claim 1, wherein said developer solution additionally contains 6-nitrobenzimidazole nitrate.

5. The process as claimed in claim 1, wherein said developer solution additionally contains a poly(oxyethylene)glycol or a cationic, nonionic or anionic derivative thereof, said poly-(oxyethylene)glycol being soluble in water or swelled by water.

6. The process as claimed in claim 5, wherein said developer solution additionally contains 6-nitrobenzimidazole nitrate.

7. The process as claimed in claim 5, wherein said poly-(oxyethylene)glycol or derivative thereof has a molecular weight ranging from about 400 to 4000.

8. The process as claimed in claim 7, wherein said poly(oxyethylene)glycol or derivative thereof is a poly-(oxyethylene)glycol methylphenyl ether, a poly(oxyethylene) alkyl ether, a poly(oxyethylene) nonylphenyl ether, a poly(oxyethylene) sorbitan ester, a poly(oxyethylene)-(oxypropylene) block copolymer, a poly(oxyethylene) alkyl ester, a poly(oxyethylene)-bis(pyridinium methane sulfonate) or a polyethoxyethyl-bis-sulfuric acid.

9. The process as claimed in claim 7, wherein said poly(oxyethylene)glycol or derivative thereof is poly-(oxyethylene) glycol.

10. The process as claimed in claim 6, wherein said 1-phenyl-3-pyrazolidone, said poly(oxyethylene)glycol or derivative thereof, and said 6-nitrobenzimidazole nitrate are present at a level of from about 0.05 to 0.5 g, about 0.5 to 5 g and about 5 to 150 mg, respectively, per liter of developer solution.

* * * * *